US011486645B2

(12) United States Patent
Roy

(10) Patent No.: US 11,486,645 B2
(45) Date of Patent: Nov. 1, 2022

(54) MOUNTING SYSTEM FOR PRESSURE SWITCH PROVIDING BOTH MECHANICAL SUPPORT AND INTEGRATED PRESSURE COMMUNICATION

(71) Applicant: Nidec Motor Corporation, St. Louis, MO (US)

(72) Inventor: William J. Roy, Thompson Station, TN (US)

(73) Assignee: Nidec Motor Corporation, St. Louis, MO (US)

( * ) Notice: Subject to any disclaimer, the term of this patent is extended or adjusted under 35 U.S.C. 154(b) by 1008 days.

(21) Appl. No.: 16/203,714

(22) Filed: Nov. 29, 2018

(65) Prior Publication Data

US 2019/0368816 A1 Dec. 5, 2019

Related U.S. Application Data

(60) Provisional application No. 62/678,118, filed on May 30, 2018.

(51) Int. Cl.

| | |
|---|---|
| ***F27D 21/00*** | (2006.01) |
| ***F23N 5/18*** | (2006.01) |
| ***F23N 5/00*** | (2006.01) |

(52) U.S. Cl.

CPC ..... *F27D 21/00* (2013.01); *F23N 5/00* (2013.01); *F23N 5/18* (2013.01); *F23N 2005/182* (2013.01); *F23N 2225/04* (2020.01); *F27D 2021/0007* (2013.01)

(58) Field of Classification Search

CPC ..... F27D 21/00; F23N 2900/05004; F23N 2900/05005

See application file for complete search history.

(56) References Cited

U.S. PATENT DOCUMENTS

| | | | | |
|---|---|---|---|---|
| 5,341,795 | A | 8/1994 | Chou et al. | |
| 6,307,344 | B1 | 10/2001 | Pajak et al. | |
| 6,537,030 | B1 | 3/2003 | Garrison | |
| 7,071,643 | B2 | 7/2006 | Prevo et al. | |
| 7,109,616 | B2 | 9/2006 | Grzywacz et al. | |
| 7,128,526 | B2 | 10/2006 | Paulsen | |
| 7,182,574 | B2 | 2/2007 | Lyons | |
| 7,210,903 | B2 | 5/2007 | Lyons | |
| 7,278,823 | B2 | 10/2007 | Platz | |
| 8,584,664 | B2 | 11/2013 | Sarimurat et al. | |
| 2002/0053603 | A1* | 5/2002 | Bernini | G01L 19/0092 237/8 R |
| 2012/0009059 | A1 | 1/2012 | Okamoto et al. | |
| 2022/0260444 | A1* | 8/2022 | Ashino | G01L 19/0038 |

* cited by examiner

*Primary Examiner* — David J Laux

(74) *Attorney, Agent, or Firm* — Hovey Williams LLP

(57) ABSTRACT

A mounting system for mounting a pressure switch to a mounting body without using screws or brackets. The mounting system includes a support physically supporting the pressure switch on the mounting body, a conduit carrying a pressure signal from the mounting body to the pressure switch, and a connector extending between and connecting the support to the conduit. The support and conduit may have ends constructed of synthetic rubber to frictionally engage support and conduit mounts, and the support and conduit may have approximately the same length and/or the same cross-sectional shape. The mounting body may be a draft inducer, a condensate collector box, or a drain trap in a furnace.

20 Claims, 4 Drawing Sheets

MOUNTING SYSTEM FOR PRESSURE SWITCH PROVIDING BOTH MECHANICAL SUPPORT AND INTEGRATED PRESSURE COMMUNICATION

RELATED APPLICATIONS

The present U.S. non-provisional patent application is related to and claims priority benefit of an earlier-filed U.S. provisional patent application Ser. No. 62/678,118, filed May 30, 2018. The entire content of the identified earlier-filed application is incorporated by reference as if fully set forth herein.

FIELD

The present invention relates to pressure switches, and more particularly, embodiments concern a mounting system for a pressure switch which provides both mechanical support and integrated pressure communication.

BACKGROUND

Pressure switches are often mounted to furnace components (e.g., inducer housings, collector boxes, and drain traps). The most common mounting solutions utilize screws through sheet metal or molded brackets into both the bodies of the switches and the mounting surfaces. Screws add cost, can be easily lost, tend to strip, require additional clearance to employ, and require a tool to attach or remove the pressure switch from its assembly. As a result, mounting screws are often missing and the switches may by improperly and insufficiently supported only by the attached pressure hoses. An alternative mounting solution utilizes snap-fit mountings which make use of the flexibility of the materials from which the switch body and/or mounting surface are constructed.

For example, in a gas furnace, a draft inducer and a pressure switch work together to remove toxic gases. The inducer is a fan that pulls air from the combustion chamber and vents it externally. During operation, the inducer creates a vacuum inside the furnace combustion chamber, and the pressure switch confirms that the inducer is operating by sensing this vacuum. Thus, if the pressure switch is improperly mounted it could fail to sense the operation or inoperation of the inducer.

This background discussion is intended to provide information related to the present invention which is not necessarily prior art.

SUMMARY

Embodiments address the above-described and other problems by providing a mounting system for a pressure switch which provides both mechanical support and integrated pressure communication. In a first embodiment, a mounting system is provided for mounting a pressure switch to a mounting body. The mounting system may include a support and a conduit. The support may be configured to physically support the pressure switch on the mounting body, and may include a first support end configured to engage a first mount of the pressure switch, a second support end configured to engage a second mount of the mounting body, and an intermediate support portion extending between the first and second support ends. The conduit may be connected to the support and configured to carry a pressure signal from the mounting body to the pressure switch, and may include a first conduit end configured to engage a first pressure tap of the pressure switch, a second conduit end configured to engage a second pressure tap of the mounting body, and an intermediate conduit portion extending between the first and second ends.

Various implementations of the first embodiment may include any one or more of the following additional features. The first and second support ends may engage the first and second mounts, respectively, and the first and second conduit ends may engage the first and second pressure taps, respectively, with friction fits. The support and the conduit may have approximately a same length and a different cross-sectional shape, a different length and approximately the same cross-sectional shape, or approximately a same length and approximately a same cross-sectional shape. The support and conduit may share a common longitudinal axis. The support may be directly connected to the conduit. The mounting system may further include a connector configured to connect the support and the conduit, and the connector may include a first connector side attached to the support, a second connector side attached to the conduit, and an intermediate connector portion extending between the first and second sides and connecting the support to the conduit. The mounting body may be a draft inducer or a condensate collector box of a furnace.

In a second embodiment, a furnace is provided, wherein the furnace includes a pressure switch, a mounting body, and a mounting system for mounting the pressure switch to the mounting body. The mounting assembly includes a support physically supporting the pressure switch on the mounting body, and a conduit connected to the support and configured to carry a pressure signal from the mounting body to the pressure switch. The mounting assembly includes a first support end engaging the first mount of the pressure switch, a second support end engaging the second mount of the mounting body, and an intermediate support portion extending between the first and second support ends. The conduit includes a first conduit end engaging the first pressure tap of the pressure switch, a second conduit end engaging the second pressure tap of the mounting body, and an intermediate conduit portion extending between the first and second ends.

Various implementations of the second embodiment may include any one or more of the following additional features. The synthetic rubber may be ethylene propylene diene terpolymer. The support and the conduit may have approximately a same length and approximately a same cross-sectional shape.

This summary is not intended to identify essential features of the present invention, and is not intended to be used to limit the scope of the claims. These and other aspects of the present invention are described below in greater detail.

DRAWINGS

Embodiments of the present invention are described in detail below with reference to the attached drawing figures, wherein.

Figure 10:
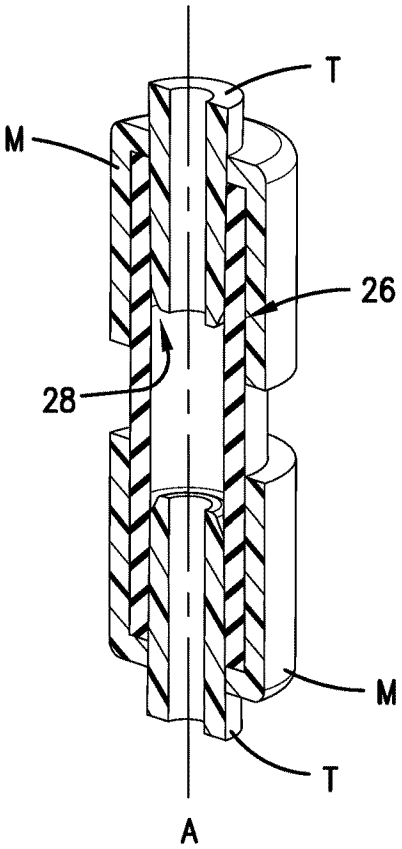
Figure 9:
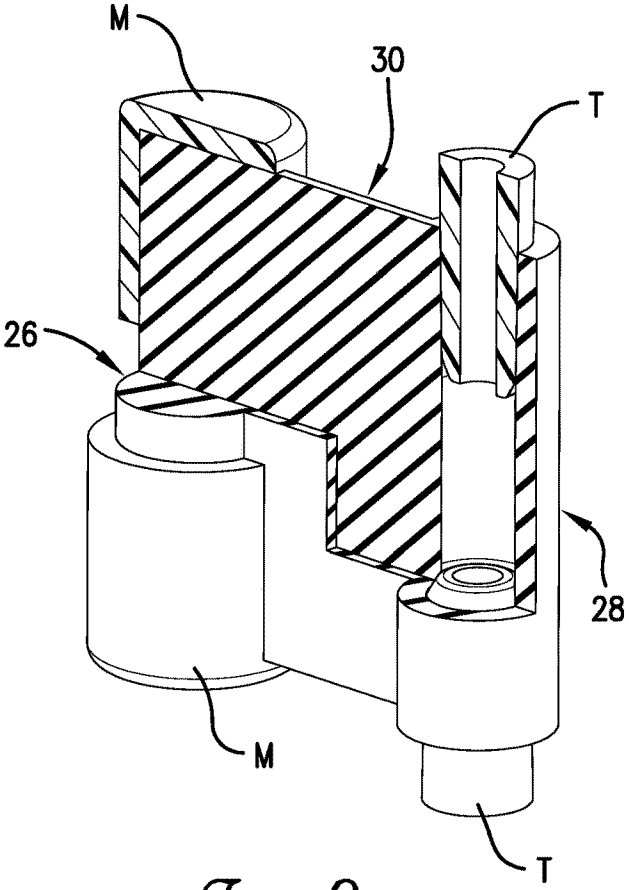

FIG. 9 is a sixth implementation of the mounting system in which the support is received within opposed mounts and the conduit receives opposed taps, with the mounting system and mounts being shown in partially sectioned end and side elevation views; and FIG. 10 is a seventh implementation of the mounting system in which the support and conduit share a common longitudinal axis with the mounting system and mounts being shown in partially sectioned end and side elevation views.

The figures are not intended to limit the present invention to the specific embodiments they depict. While the drawings do not necessarily provide exact dimensions of tolerances for the illustrated components or structures, the drawings, not including any purely schematic representations, are to scale with respect to the relationships between the components of the structures illustrated therein.

DETAILED DESCRIPTION

The following detailed description of embodiments of the invention references the accompanying figures. The embodiments are intended to describe aspects of the invention in sufficient detail to enable those with ordinary skill in the art to practice the invention. Other embodiments may be utilized and changes may be made without departing from the scope of the claims. The following description is, therefore, not limiting. The scope of the present invention is defined only by the appended claims, along with the full scope of equivalents to which such claims are entitled.

In this description, references to "one embodiment," "an embodiment," or "embodiments" mean that the feature or features referred to are included in at least one embodiment of the invention. Separate references to "one embodiment," "an embodiment," or "embodiments" in this description do not necessarily refer to the same embodiment and are not mutually exclusive unless so stated. Specifically, a feature, component, action, step, etc. described in one embodiment may also be included in other embodiments, but is not necessarily included. Thus, particular implementations of the present invention can include a variety of combinations and/or integrations of the embodiments described herein.

Broadly characterized, embodiments concern a mounting system for a pressure switch which provides both mechanical support and integrated pressure communication. In more detail, embodiments provide a mounting system configured both to physically support the pressure switch on a mounting body and to provide an integrated pressure conduit for communicating a pressure signal from the mounting body to the pressure switch. Embodiments may utilize a flexible elastic mounting material both to achieve a friction or interference fit to connect and support the pressure switch on the mounting body (e.g., a draft inducer, condensate collector box, or drain trap) and to provide a conduit for carrying the pressure signal to the pressure switch for operation. The required mounting geometry for use with the mounting system may be molded directly into the pressure switch and the mounting body. Thus, the separate conventional mounting screws and brackets and the separate conventional pressure hose are replaced with the single mounting system which better performs both operations.

This use of a flexible material as both a mounting mechanism and an integral pressure conduit provide a number of advantages, including increasing robusticity and ease of installation while reducing cost and complexity of manufacture; reducing the number of parts, the actual material costs, and the time required to mount the pressure switch; holding pressure without the risk of stripping screws, and providing more twist robustness than a single point mounting mechanism; allowing for multiple assemblies and disassemblies without the risk of stripping or losing screws or breaking snap fittings; ensuring that the proper mount and pressure conduit are always present together and therefore utilized as such for assembly and field service; minimizing risk of loss by ensuring that, once assembled, the mounting system is always fastened to either the pressure switch or to the mounting body; ensuring that the pressure switch is mounted in both its proper location and its proper orientation; and damping vibrations that would otherwise be transmitted to a hard-mounted switch during shipping, thereby keeping the switch setpoint calibration closer to its factory setting.

Although described herein in the context of a pressure switch mounted to an inducer or collector box in a furnace "F," it will be appreciated that embodiments may be adapted for use in substantially any suitable application, such as gas furnaces, gas water heaters, gas boilers, heating, ventilation, and air condition (HVAC) duct pressure sensing, air mattress pressure control, and other low pressure pneumatic air proving applications as well as carbon dioxide/carbon monoxide (CO2/CO) remote duct sensors.

Figure 1:
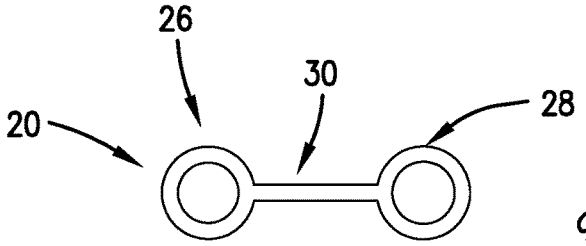
FIG. 1 is an end elevation view of an embodiment of a mounting system.
Figure 2:
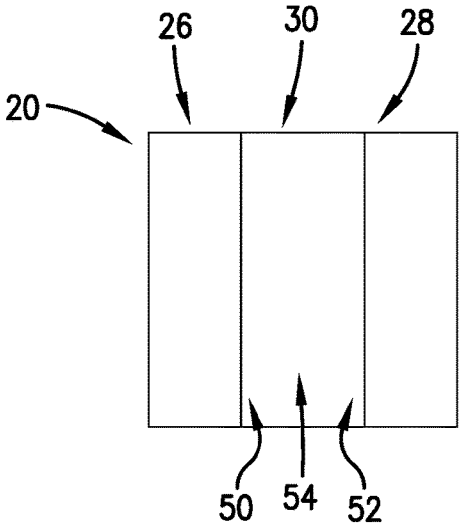
FIG. 2 is a side elevation view of the mounting system of FIG. 1.
Figure 3:
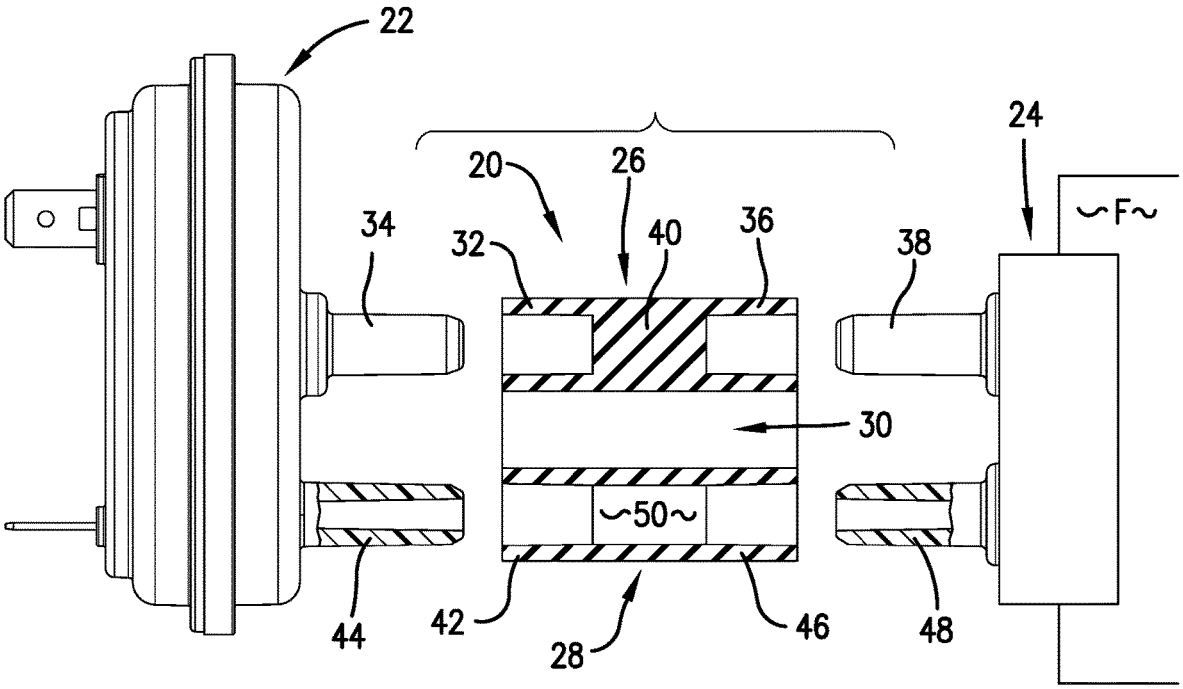
FIG. 3 is an exploded side elevation view of the mounting system of FIG. 1 shown operationally interposed between a pressure switch and a mounting body.

Referring to FIGS. 1, 2, and 3, a mounting system 20 is shown for both mechanically supporting a pressure switch 22 on a mounting body 24 and providing integrated pressure communication between the pressure switch 22 and the mounting body 24. In one implementation, the mounting system 20 may include a support 26, a conduit 28, and a connector 30. Portions or all of the mounting system 20 may be constructed from substantially any suitable material or combination of materials, such as a synthetic rubber. Most preferably, the support 26, conduit 28, and connector 30 are components of a single integrally formed body (e.g., a molded or extruded body). One suitable flexible material for forming the body is ethylene propylene diene terpolymer (EPDM).

The support 26 may have a first support end 32 configured to engage a first mount 34 of the pressure switch 22, a second support end 36 configured to engage a second mount 38 of the mounting body 24, and an intermediate support portion 40 extending between the first and second support ends 32, 36 and configured to physically support the pressure switch 22 on the mounting body 24. As desired or needed, a portion or all of the intermediate support portion 40 may be open or filled. The conduit 28 may have a first conduit end 42 configured to engage a first pressure tap 44 of the pressure switch 22, a second conduit end 46 configured to engage a second pressure tap 48 of the mounting body 24, and an intermediate conduit portion 50 extending between the first and second conduit ends 42, 46 and configured to carry a pressure signal from the mounting body 24 to the pressure switch 22. At least the ends of the support and conduit 26, 28 may be constructed of a flexible material such as the synthetic rubber so as to frictionally engage the support projections and pressure taps.

In the first illustrated embodiment, each of the mounts 34, 38 comprises a projection received in the respective support end 32, 36. The projection most preferably comprises a barbed connector inserted into the respective support end. Certain aspects of the present invention are equally applicable to alternative mount constructions, such as one or both of the mounts comprising a reversed opening or sleeve which receives the corresponding support end. The illustrated taps 44, 48 are preferably similarly constructed (most preferably being a tubular barbed connector), with alternative designs likewise being acceptable for certain aspects of the present invention. It is also appreciated that the conduit 28 is tubular so that the pressure switch 22 fluidly communicate with the inside of the mounting body 24, with the preferred pressure signal consequently being direct fluid pressure of the mounting body 24. The strength of the pressure signal may vary with the application. For example, in an induced draft furnace the pressure signal may be approximately between −0.2 inwc and −3 inwc, while burner box feedback signals may be approximately between 0 inwc and 1 inwc, and air mattress transducers may measure approximately between 0 inwc and 5 inwc.

The connector 30 may have a first side 50 attached to the support 26, a second side attached 52 to the conduit 28, and an intermediate connector portion 54 extending between the first and second sides 50, 52 and connecting the support 26 to the conduit 28. The connector 30 may be constructed of the same or similar flexible material as the support and conduit components 26, 28. The illustrated connector 30 is a flat panel extending between and directing the support 26 and conduit. As desired or needed, the connector 30 may be shaped to accommodate structures on the pressure switch 22 and/or on the mounting body 24 between the engaged support and conduit 26,28.

Figure 5:
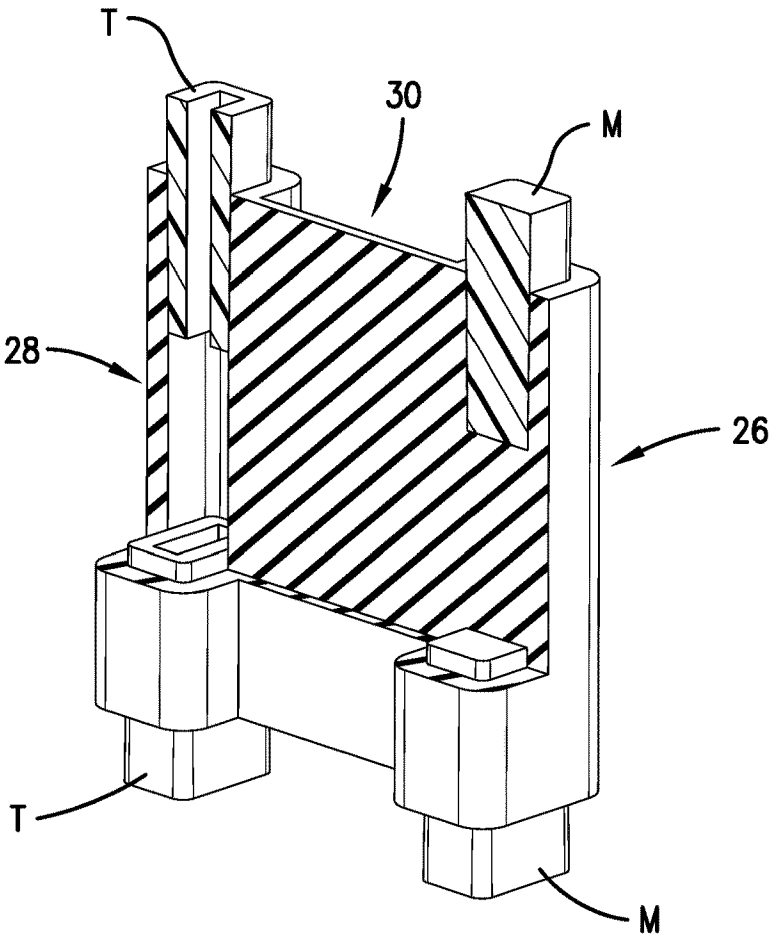
FIG. 5 is a second implementation of the mounting system in which the support and conduit have similar lengths and rectangular cross-sectional shapes with the mounting system and mounts being shown in partially sectioned end and side elevation views.
Figure 4:
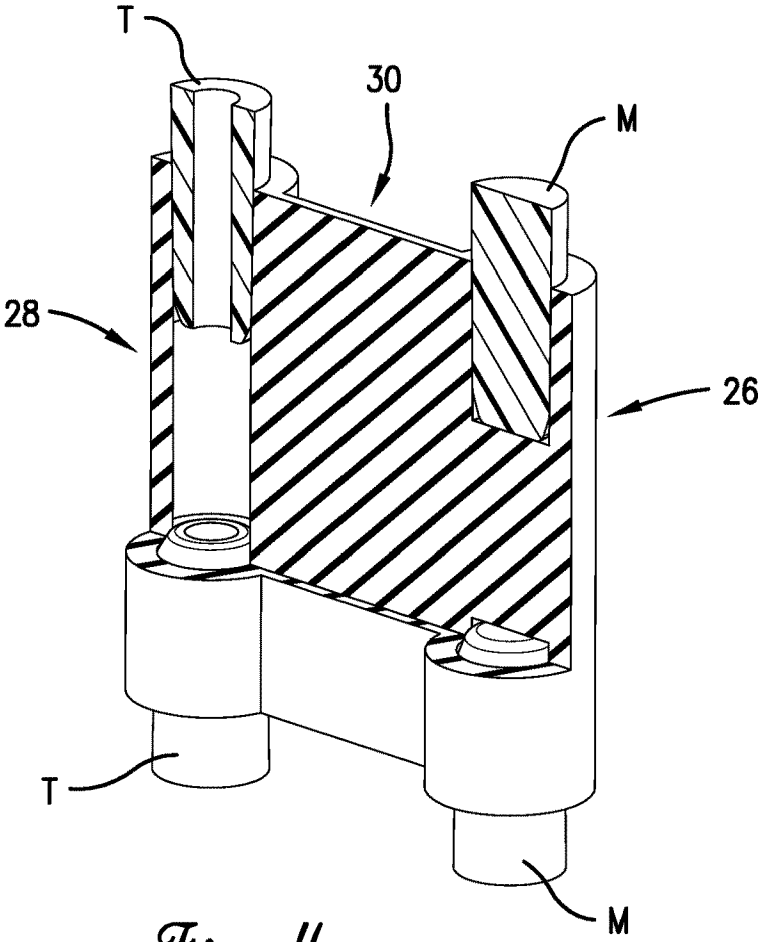
FIG. 4 is a first implementation of the mounting system in which the support and conduit have similar lengths and circular cross-sectional shapes with the mounting system and mounts being shown in partially sectioned end and side elevation views.
Figure 7:
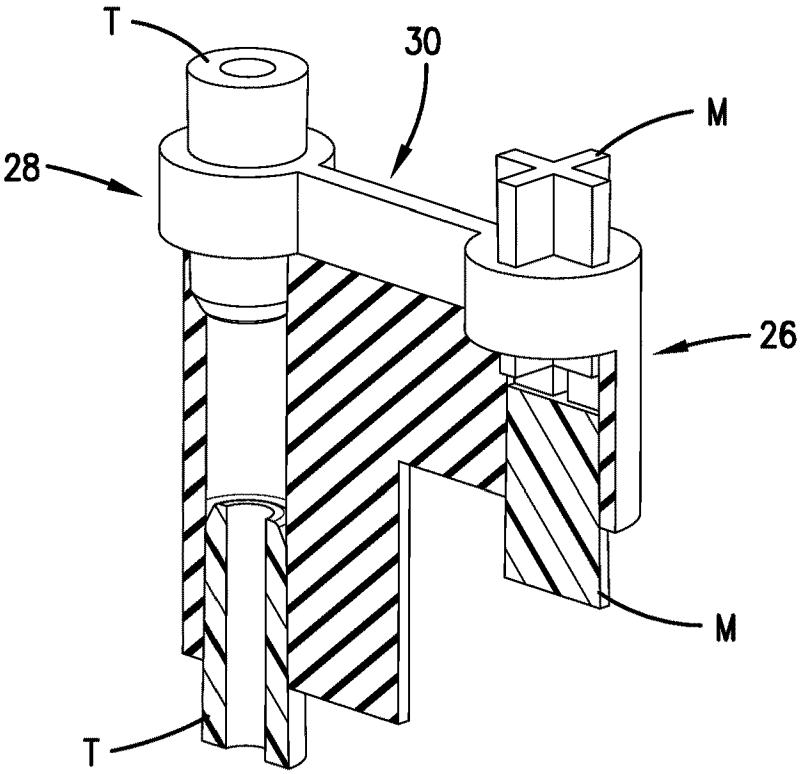
FIG. 7 is a fourth implementation of the mounting system in which the support and conduit have similar lengths and different cross-sectional shapes and engage mounts of different lengths with the mounting system and mounts being shown in partially sectioned end and side elevation views.
Figure 6:
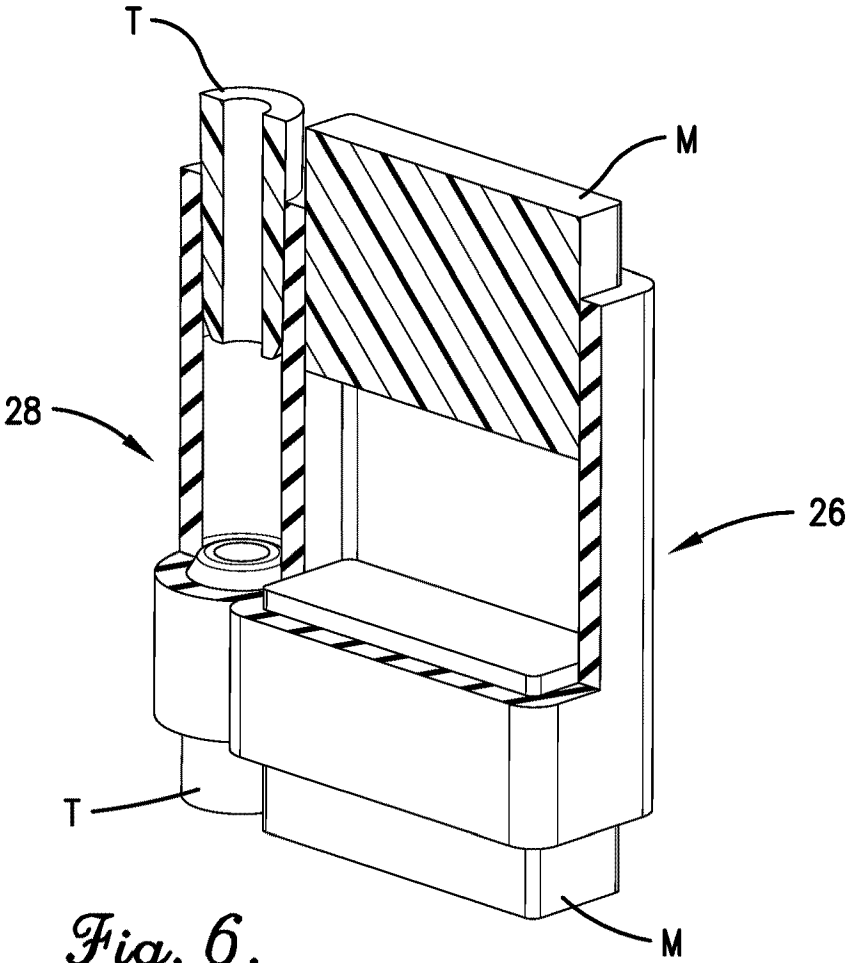
FIG. 6 is a third implementation of the mounting system in which the support and conduit have similar lengths and different cross-sectional shapes and engage mounts of similar lengths with the mounting system and mounts being shown in partially sectioned end and side elevation views.
Figure 8:
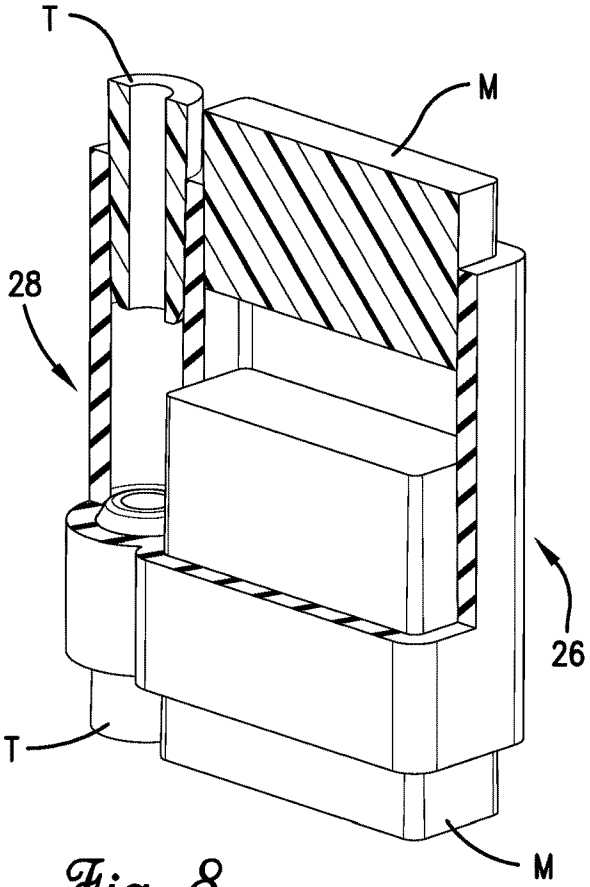
FIG. 8 is a fifth implementation of the mounting system in which the support and conduit have different lengths and different cross-sectional shapes with the mounting system and mounts being shown in partially sectioned end and side elevation views.

In various alternative implementations, examples of which are shown in FIGS. 4-10, the support 26 and the conduit 28 may have approximately the same length and shape (as shown in FIGS. 4 and 5), may have approximately the same length but different shapes (as shown in FIGS. 6 and 8), may have different lengths but approximately the same shape (as shown in FIG. 7), and/or the connector 30 may be eliminated in which case the support 26 may be directly attached to the conduit 28 (as shown in FIGS. 7, 8, and 10). The different lengths and shapes provide different holding strengths, opportunities to minimize material, and opportunities for mounting to angled surfaces or other complex shapes. The taps T and mounts M are shown somewhat schematically in these views.

As used herein, the term "approximately" shall mean equal to or within plus and minus ten percent of the stated number or range of numbers, unless otherwise stated. For example, approximately the same length means lengths within plus or minus ten percent of each other, and approximately circular means minor and major diameters within plus or minus ten percent of each other.

In particular, in the implementation shown in FIG. 4 the support 26 and the conduit 28 may both have an approximately circular or otherwise round cross-section and may be approximately the same length, and the intermediate component (e.g., connector 30) may extend between and connect them. The implementation shown in FIG. 5 may be substantially similar or identical to that of FIG. 4 except that the support and conduit 26, 28 may have approximately square or otherwise approximately rectangular cross-sections.

In the implementation shown in FIG. 6 the support 26 may have an approximately rectangular cross section, the conduit 28 may have an approximately circular or otherwise round cross-section, the support and conduit 26, 28 may be approximately the same length, and the intermediate component 30 may be eliminated such that the support and conduit 26, 28 are directly connected to each other. The implementation shown in FIG. 7 may be substantially similar or identical to that of FIG. 6 except that the support 26 is shown accommodating the mounts M and/or taps T having different lengths.

In the implementation shown in FIG. 8 the support 26 may have an approximately cross-shaped cross section, the conduit 28 may have an approximately circular or otherwise round cross-section, the support 26 may be substantially shorter than the conduit 28, and the connector 30 may extend between and connect them. It will be appreciated that this configuration could be reversed, with the support 26 being longer than the conduit 28. Although shown as having an "L" shape to accommodate the different length of the support and conduit components 26, 28, the connector 30 alternatively may be angled or may be substantially square or otherwise substantially rectangular and connect to the longer component along less than its full length.

In the implementations shown in FIGS. 4-8 the support and conduit 26,28 are shown receiving or fitting over the mounts M and taps T. In the implementation shown in FIG. 9 the support 26 is shown being received by or fitting into the mounts M and the conduit 28 is shown receiving or fitting over the taps T. In the implementation shown in FIG. 10 the support and conduit 26, 28 are integrated together and share a common longitudinal axis "A," with the outer support 26 being received by or fitting into the mounts M and the inner conduit 28 receiving or fitting over the taps T.

Although the invention has been described with reference to the one or more embodiments illustrated in the figures, it is understood that equivalents may be employed and substitutions made herein without departing from the scope of the invention as recited in the claims.

Having thus described one or more embodiments of the invention, what is claimed as new and desired to be protected by Letters Patent includes the following:

1. A mounting system for mounting a pressure switch to a mounting body, wherein the pressure switch includes a first mount and a first tap and the mounting body includes a second mount and a second tap, the mounting system comprising:

a support configured to physically support the pressure switch on the mounting body, the support including— a first support end configured to engage the first mount of the pressure switch, a second support end configured to engage the second mount of the mounting body, and an intermediate support portion extending between the first and second support ends; and a conduit connected to the support and configured to carry a pressure signal from the mounting body to the pressure switch, the conduit including— a first conduit end configured to engage the first pressure tap of the pressure switch, a second conduit end configured to engage the second pressure tap of the mounting body, and an intermediate conduit portion extending between the first and second ends.

2. The mounting system of claim 1, wherein the support and the conduit have approximately a same length and a different cross-sectional shape.

3. The mounting system of claim 1, wherein the support and the conduit have a different length and a different cross-sectional shape.

4. The mounting system of claim 1, wherein the support and the conduit have approximately a same length and a same cross-sectional shape.

5. The mounting system of claim 1, wherein the support and the conduit share a common longitudinal axis.

6. The mounting system of claim 1, wherein the support is directly connected to the conduit.

7. The mounting system of claim 1, further including a connector configured to connect the support and the conduit, the connector including— a first connector side attached to the support, a second connector side attached to the conduit, and an intermediate connector portion extending between the first and second sides and connecting the support to the conduit.

8. A mounting system for mounting a pressure switch to a mounting body in a furnace, wherein the pressure switch includes a first mount and a first tap and the mounting body includes a second mount and a second tap, the mounting system comprising:

a support configured to physically support the pressure switch on the mounting body, the support including— a first support end constructed of a synthetic rubber and configured to frictionally engage the first mount of the pressure switch, a second support end constructed of the synthetic rubber and configured to frictionally engage the second mount of the mounting body, and an intermediate support portion extending between the first and second support ends;

a conduit connected to the support and configured to carry a pressure signal from the mounting body to the pressure switch, the conduit including— a first conduit end constructed of the synthetic rubber and configured to frictionally engage the first pressure tap of the pressure switch, a second conduit end constructed of the synthetic rubber and configured to frictionally engage the second pressure tap of the mounting body, and an intermediate conduit portion extending between the first and second ends; and a connector configured to connect the support and the conduit, the connector including— a first connector side attached to the support, a second connector side attached to the conduit, and an intermediate connector portion extending between the first and second sides and connecting the support to the conduit.

9. The mounting system of claim 8, wherein the synthetic rubber is ethylene propylene diene terpolymer.

10. The mounting system of claim 8, wherein the support and the conduit have approximately a same length and a same cross-sectional shape.

11. A furnace comprising:

a pressure switch including a first mount and a first tap;

a mounting body including a second mount and a second tap; and a mounting system for mounting the pressure switch to the mounting body, the mounting system including— a support physically supporting the pressure switch on the mounting body, the support including— a first support end engaging the first mount of the pressure switch, a second support end engaging the second mount of the mounting body, and an intermediate support portion extending between the first and second support ends, a conduit connected to the support and configured to carry a pressure signal from the mounting body to the pressure switch, the conduit including— a first conduit end engaging the first pressure tap of the pressure switch, a second conduit end engaging the second pressure tap of the mounting body, and an intermediate conduit portion extending between the first and second ends.

12. The furnace of claim 11, wherein the first and second support ends engage the first and second mounting projections, respectively, and the first and second conduit ends engage the first and second pressure taps, respectively, with friction fits.

13. The furnace of claim 12, wherein the first and second mounting projections receive the first and second support ends, respectively.

14. The furnace of claim 12, wherein the first and second conduit ends receive the first and second pressure taps, respectively.

15. The furnace of claim 11, wherein the support and the conduit have approximately a same length and a same cross-sectional shape.

16. The furnace of claim 11, wherein the support and the conduit share a common longitudinal axis.

17. The furnace of claim 11, wherein the support is directly connected to the conduit.

18. The furnace of claim 11, the mounting assembly including a connector interconnecting the support and the conduit, the connector including— a first connector side attached to the support, a second connector side attached to the conduit, and an intermediate connector portion extending between the first and second sides and connecting the support to the conduit.

19. The furnace of claim 11, wherein the mounting body comprises a draft inducer.

20. The furnace of claim 11, wherein the first and second mounts each comprises a projection received in the respective one of the support ends of the support.

* * * * *